US005110253A

United States Patent [19]

Ernst et al.

[11] Patent Number: 5,110,253

[45] Date of Patent: May 5, 1992

[54] TWO-LEVER THREE FUNCTION CONTROL MECHANISM

[75] Inventors: Paul J. Ernst, Dubuque; Rex A. Hanson, Peosta, both of Iowa

[73] Assignee: Deere & Company, Moline, Ill.

[21] Appl. No.: 632,309

[22] Filed: Dec. 21, 1990

[51] Int. Cl.[5] ..... G05G 1/24; E02F 9/20

[52] U.S. Cl. ..... 414/694; 74/471; 74/491

[58] Field of Search ..... 74/471, 491; 137/637; 414/694, 685

[56] References Cited

U.S. PATENT DOCUMENTS

| | | | |
|---|---|---|---|
| 2,818,746 | 1/1958 | Hart | 74/480 |
| 3,424,024 | 1/1969 | Derbfuss | 74/480 |
| 3,795,152 | 3/1974 | Campbell | 74/471 |
| 3,955,437 | 5/1976 | Heintz | 74/491 X |
| 3,993,175 | 11/1976 | Beveridge | 192/3.57 |
| 4,054,083 | 10/1977 | Utter | 137/637 X |
| 4,098,286 | 7/1978 | Prime | 137/270 |
| 4,389,151 | 6/1983 | Brown | 414/685 |
| 4,526,055 | 7/1985 | Batchelor et al. | 74/471 XY |
| 4,716,399 | 12/1987 | Nordlund | 340/365 |
| 4,938,091 | 7/1990 | Waggoner et al. | 74/471 |

FOREIGN PATENT DOCUMENTS 9013863 11/1990 European Pat. Off. .

OTHER PUBLICATIONS

Page 8613 of the PCT Gazette No. 26/100; abstract of International Publication WO 90/13863.

*Primary Examiner*—Richard Lorence
*Assistant Examiner*—Khoi Q. Ta

[57] ABSTRACT

Three functions on a work vehicle are controlled by two interconnected levers. The first lever controls the first and second functions and the second lever controls the first and third functions. The control levers are interconnected by a yoke having three downwardly projecting tangs. Two of the tangs are provided with connections points for the first and second control function linkages. The third tang provides a mounting point for a ball joint. A stub shaft is coupled to the yoke and the main ball joint and projects from the yoke into a stationary guide slot. The second lever is mounted to the stub shaft and the yoke. The second lever is also provided with a link having a connection point for the third control function linkage.

17 Claims, 4 Drawing Sheets

TWO-LEVER THREE FUNCTION CONTROL MECHANISM

BACKGROUND OF THE INVENTION

1. Field of the Invention

The invention is directed to a two-lever three-function control mechanism for independently controlling the positioning of three separate hydraulic control valves.

2. Description of the Prior Art

In operating a work vehicle, such as a loader backhoe, the operator controls a plurality of work operations through manipulating various control levers that control the positioning of hydraulic control valves. The hydraulic control valves in turn regulate the flow of hydraulic fluid to hydraulic cylinders that manipulate the work implement. While using a loader the operator may also be turning the steering wheel and shifting the transmission as he loads and unloads the bucket.

The operator may be provided with a single lever that controls both raising and lowering the boom, and tilting the bucket. By moving this lever in a first plane, front-to-back, the position of the boom is manipulated. By moving this lever in a second plane, side-to-side, the bucket tilt is adjusted.

Many times the bucket maybe provided with a third function, for example a side tilt bucket or a clam shell bucket. The third function typically requires a third hydraulic cylinder and a third hydraulic control valve for controlling the positioning of this cylinder. The control mechanism for controlling the third hydraulic control valve may comprise a single control lever, such as that disclosed in U.S. Pat. No. 4,938,091, or two control levers, such as that disclosed in U.S. Pat. No. 4,389,151.

In the two control lever mechanism, shown in U.S. Pat. No. 4,389,151, it is desirable that the second control lever move with the first control lever, so that the second control lever is always close at hand when manipulating the work implement with the first control lever. The first and second levers disclosed in this patent move together in a first plane and independently of one another in parallel second and third planes. They are coupled together by a link extending between the control levers.

SUMMARY

It is an object of the present invention to provide a two-lever control mechanism regulating three functions, in which the first control lever controls the first and second functions by manipulating the lever in first and second perpendicular planes, and the second control lever is coupled to the first control lever so that it moves with the first control lever in the first plane and can be independently manipulated by the operator in a third plane that is parallel to the second plane.

It is another object of the present invention to provide a compact two-lever control mechanism wherein the first control lever is provided with a yoke for controlling the first and second functions, and a stub shaft is coupled to the yoke for holding the second control lever which controls the third function.

The present invention comprises a first control lever having a downwardly extending yoke with three tangs. The first tang is provided with a first connection point for the linkage controlling the manipulation of the first hydraulic control valve and thereby the first function.

The second tang is provided with a second connection point for the linkage controlling the manipulation of the second hydraulic control valve and thereby the second function. The third tang is provided with a yoke mounting point.

A bracket is mounted to the supporting frame of the vehicle and is provided with a guide slot and a main bracket mounting point. A main ball joint is coupled to the main bracket mounting point. A stub shaft extends from the main ball joint through the yoke mounting point to the guide slot. The stub shaft is seated in the guide slot of the bracket to prevent it from moving in the second plane.

The second control lever is provided with a link having an aperture through which the stub shaft projects. This link is provided with a third connection point for manipulating a third hydraulic control valve and thereby the third function. The link is positioned between the yoke and the guide slot on the stub shaft.

DETAILED DESCRIPTION

Figure 1:
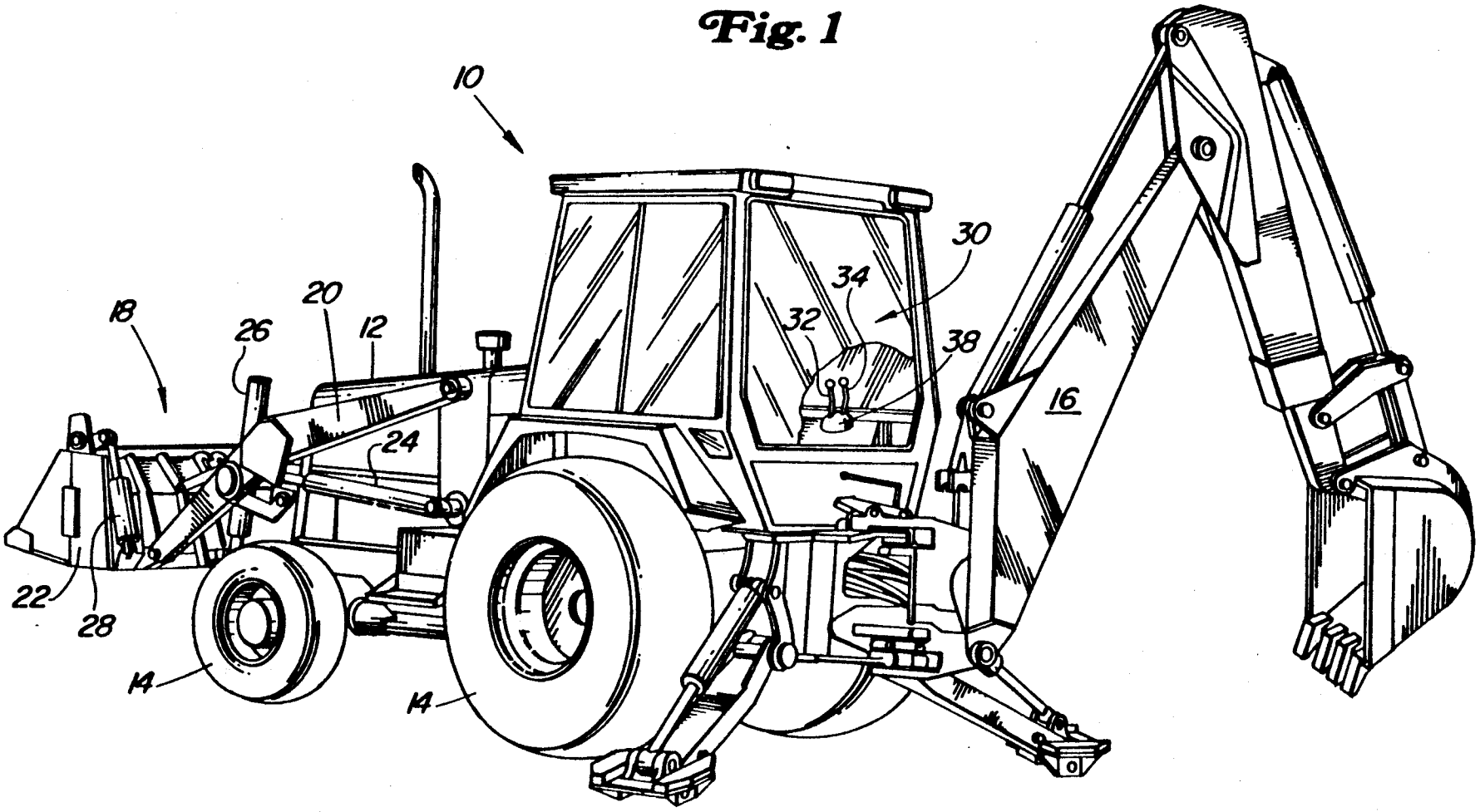
FIG. 1 is a rear perspective view of a loader backhoe.

Working vehicle 10 illustrated in FIG. 1 is a loader backhoe. The vehicle is provided with a supporting structure 12 and ground engaging means 14 comprising wheels which support and propel the supporting structure. The supporting structure is provided with two basic working implements, a backhoe 16 and a loader 18.

The loader is mounted to the front of the supporting structure and comprises a boom 20 and a grapple bucket 22. The boom is provided with a boom-lift hydraulic cylinder 24 for lifting relative to the supporting structure. The grapple bucket 22 is pivotally mounted to the end of the boom. Bucket 22 is provided with a bucket-tilt hydraulic cylinder 26 for tilting the bucket relative to the boom, and two grapple-open hydraulic cylinders 28 (only one shown) for opening and closing the grapple bucket.

The positioning of each of these hydraulic cylinders is controlled by a hydraulic control valve. These valves form a means for manipulating the three functions. The means for manipulating the three functions is mechanically signaled by an operator in the cab 30 working the control mechanism. Although the invention is being described for use on a loader backhoe, for which it is well suited, it may be used in other situations needing three-function control mechanisms.

The operator controls the operation of the loader by manipulating two control levers located on the right hand console in cab 30. The first control lever 32 located closest to the operator controls the first hydraulic function, the bucket-tilt hydraulic cylinder; and the second hydraulic function, the boom-lift hydraulic cylinder. The second control lever 34 located outwardly from the operator relative to the first control lever controls the first hydraulic function, the bucket tilt hydraulic cylinder; and the third hydraulic function, the grapple-open hydraulic cylinders.

Figure 2:
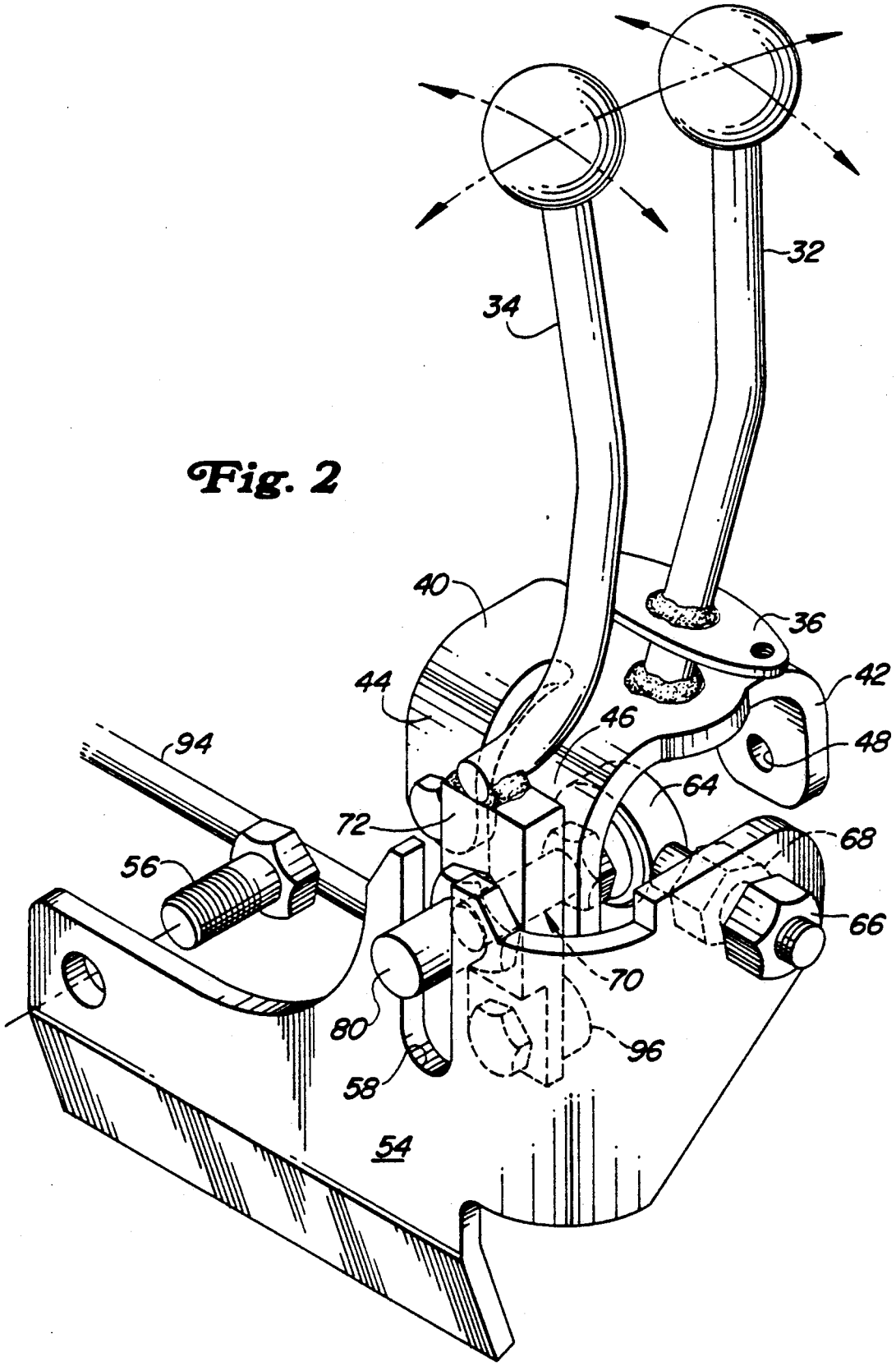
FIG. 2 is a perspective view of the control mechanism.
Figure 3:
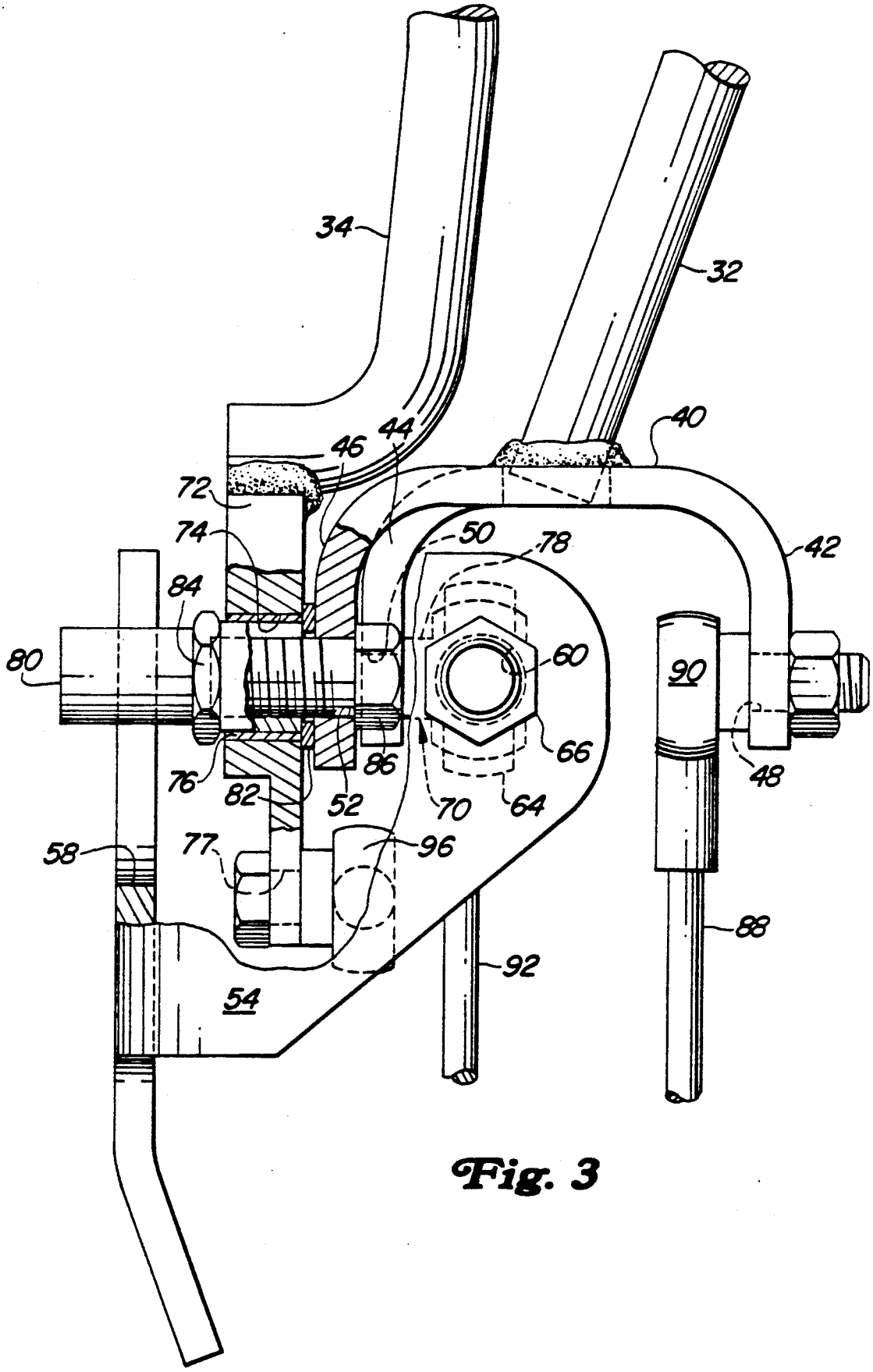
FIG. 3 is a partial cross sectional side view of the control mechanism.
Figure 4:
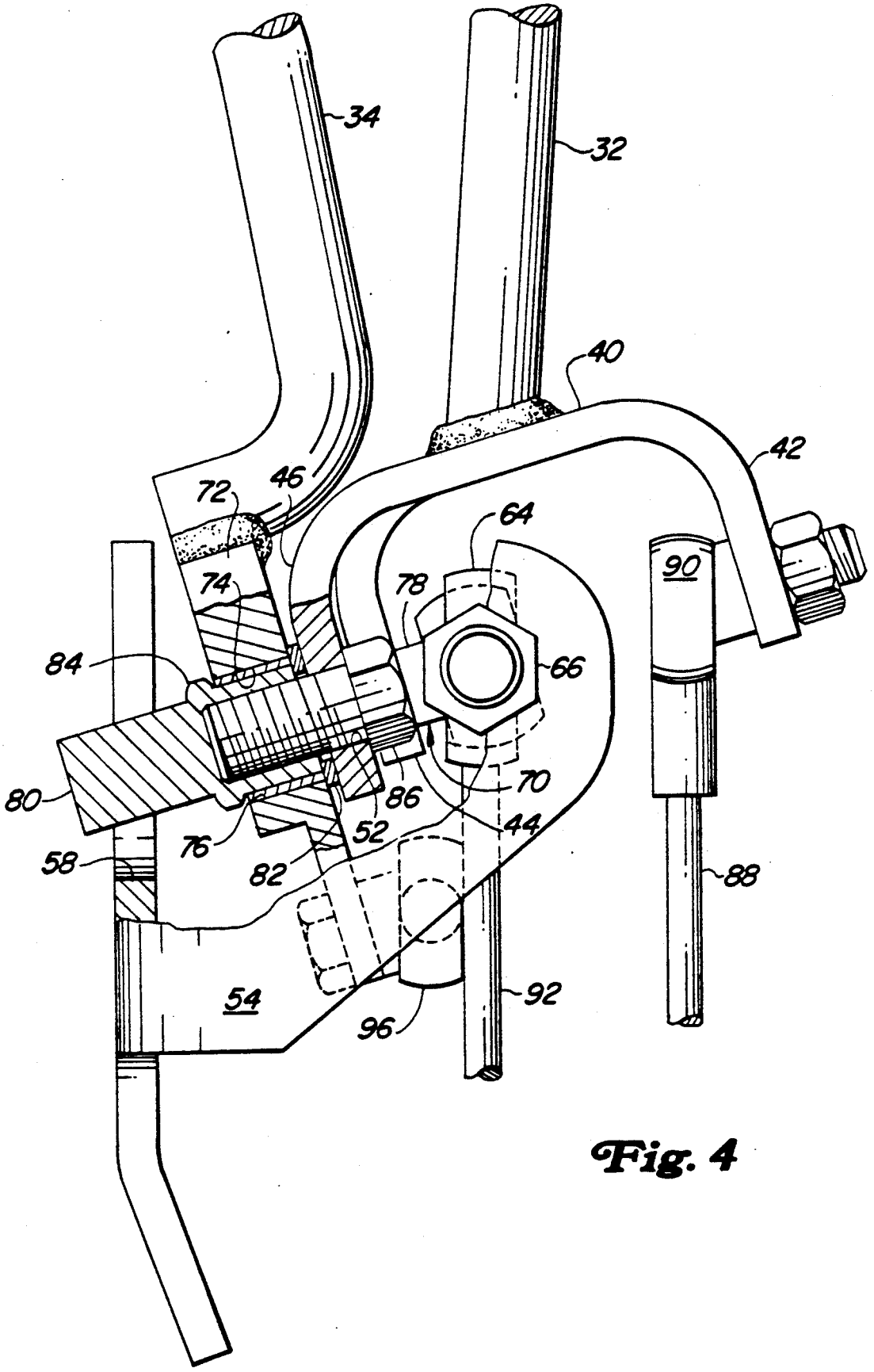
FIG. 4 is a partial cross sectional view of the control mechanism being manipulated.

The control mechanism is best illustrated in FIGS. 2–4. The first control lever 32 is provided with a cover mounting plate 36 that is welded to the control lever. A round cover 38, illustrated in FIG. 1, is mounted to the mounting plate 36. The first control lever is also provided with a control yoke 40 that is welded to the lever 32. The control yoke is provided with three downwardly projecting tangs 42, 44, and 46. The first tang 42 is provided with a first connection point 48 comprising an aperture. The second tang 44 is provided with a second connection point 50 comprising an aperture. The third tang 46 is provided with a yoke mounting point 52 also comprising an aperture.

A stationary control lever mounting bracket 54 may be mounted to the supporting structure 12 by bolt 56 or by other suitable means such as welding. Bracket 54 is provided with a vertical guide slot 58 and a control linkage mounting point 60. The control linkage mounting point comprises an aperture to which is secured main ball joint 64. The main ball joint is mounted to the mounting point 60 by a threaded shaft nuts 66 and 68. The main ball joint is provided with a stub shaft 70 which is mounted to the yoke mounting point 52 on the third tang.

The second control lever 34 is provided with a link 72 that extends downwardly from the control lever and is provided with two apertures. The first aperture 74 is provided with a bushing 76 for receiving stub shaft 70 after it passes through the yoke mounting point 52. The second aperture 77 is positioned below the stub shaft and forms a third connection point for the third function, the open-grapple function.

The stub shaft comprises two portions, a main portion 78 and an extending portion 80. The main portion is externally threaded, whereas the extending portion is internally threaded. Both portions are secured together as illustrated in FIGS. 3 and 4. The extending portion extends into the guide slot 58. Guide slot 58 prevents the stub shaft from rotating in a horizontal plane. A washer 82 is positioned between the third tang 46 and the link 72. Hexagonal portion 84 of the extending portion and nut 86 mount the link and third tang to the stub shaft.

The first connection point 48 is coupled to a link 88 by a ball joint 90 and is used to manipulate the control spool of the bucket-tilt hydraulic control valve. By moving this spool the flow of hydraulic fluid to the bucket-tilt hydraulic cylinder is regulated and the bucket tilted accordingly.

The second connection point 50 is coupled to a link 92 by a ball joint, not shown, and is used to manipulate the control spool of the boom-lift hydraulic control valve. By moving this spool the flow of hydraulic fluid to the boom-lift hydraulic cylinder is regulated and the boom lifted accordingly.

The third connection point 77 is coupled to a link 94 by a ball joint 96, and is used to manipulate the control spool of the grapple-open hydraulic control valve. By moving this spool the flow of hydraulic fluid to the grapple-open hydraulic cylinder is regulated and the grapple opened accordingly.

It is desirable that the three hydraulic control valves be mounted in a stacked configuration below the control mechanism on the supporting structure of the vehicle. It is also desirable that the control spools of these valves be horizontally manipulated. Links 88, 92 and 94 are members of suitable linkages for manipulating the control spools.

As illustrated in FIGS. 2–4 the first and second links 88 and 92 are manipulated along vertical axes, whereas third link 94 is manipulated along a horizontal axis. As such the first and second links are coupled to bell cranks which change the motion of the appropriate linkage to a horizontal motion for manipulating the control spools. As for the third link 94 two bell cranks and two additional links are necessary to direct this horizontal motion to a horizontally manipulated control spool located below the control mechanism.

Other linkage assemblies can utilize the mechanical signals transmitted by the control mechanism through links 88, 92 and 94. As such the invention should not be limited to the above described embodiment, but should be limited solely to the claims that follow.

We claim:

1. A self-propelled work vehicle for performing a work operation, the vehicle comprising:

a supporting frame;

ground engaging means for supporting and propelling the supporting frame;

a working member for performing a work operation having three functions, the working member is operatively coupled to the supporting frame;

means for manipulating the three functions of the working member is mounted to the supporting frame; and a three-function control mechanism for controlling the means for manipulating the three functions of the working member, the control mechanism having a first control lever that can be moved in a first plane and a second plane perpendicular to the first plane for controlling a first function and a second function respectively, a second control lever that can be moved in the first plane and a third plane that is parallel to the second plane for controlling a first function and a third function respectively, a control lever mounting bracket is mounted to the supporting frame and is provided with a guide slot and a control linkage mounting point, the first control lever is provided with a control yoke having a first connection point, a second connection point, and a main yoke mounting point, the first and second connection points are provided with suitable linkages for signally the means for manipulating and controlling the first and second functions when the first control lever is moved through the first and second planes respectively, a main ball joint is mounted to the control linkage mounting point, a stub shaft is coupled to the main ball joint and the main yoke mounting point, the stub shaft is also provided with an extending portion that extends into the guide slot of the control lever mounting bracket for restricting the movement of the stub shaft in the second plane, the second control lever is provided with a link that is provided with an aperture through which the stub shaft projects, the link projects on the other side of the aperture from the control lever and provides a third connection point having a suitable linkage for signalling the means for manipulating and controlling the third function, the second control lever follows the first control lever as it moves through the first plane but is independent of the first lever as it moves through the second plane, the first control lever follows the second control lever as it moves through the first plane but is independent of the second control lever as it moves through the third plane.

2. A work vehicle as defined by claim 1 wherein the control yoke is provided with first, second and third downwardly projecting tangs, wherein the linkage for the first function is coupled to the first tang, the linkage for the second function is coupled to the second tang, and the stub shaft is passed through the third tang.

3. A work vehicle as defined by claim 2 wherein the main ball joint is positioned between the first, and second tangs.

4. A work vehicle as defined by claim 3 wherein each of the tangs is provided with an aperture for coupling the respective function linkage and stub shaft to the yoke.

5. A work vehicle as defined by claim 4 wherein the stub shaft is axially aligned with the aperture in the first tang forming an axis passing through the main ball joint.

6. A work vehicle as defined by claim 5 wherein the third aperture is arranged perpendicular to the axis formed by the stub shaft and the first aperture.

7. A work vehicle as defined by claim 4 wherein the link of the second lever is positioned between the guide slot of the lever mounting bracket and the third t of the yoke.

8. A work vehicle as defined by claim 7 wherein the first and second connection points move vertically and the third connection pit moves horizontally.

9. A work vehicle as defined by claim 8 wherein the work vehicle is a loader having a movable boom and a tiltable bucket, the first function is tilting the bucket relative to the boom and the second function is moving the boom relative to the supporting frame.

10. A three-function control mechanism comprising:

a first control lever that can be moved in a first plane and a second plane perpendicular to the first plane for controlling a first function and a second function, respectively;

a second control lever that can be moved in the first plane and a third plane that is parallel to the second plane for controlling a first function and a third function, respectively;

a stationary control lever mounting bracket is provided with a guide slot and a control linkage mounting point;

the first control lever is provided with a control yoke having a first connection point, a second connection point, and a yoke mounting point, the first and second connection points are provided with suitable linkages for manipulating the first and second functions when the first control lever is moved through the first and second planes, respectively;

a main ball joint is mounted to the control linkage mounting point, a stub shaft is coupled to the main ball joint and the yoke mounting point, the stub shaft is also provided with an extending portion that extends into the guide slot of the control lever mounting bracket for restricting the movement of the stub shaft in the second plane;

the second control lever is provided with a link that is provided with an aperture through which the stub shaft projects, the link projects on the other side of the aperture from the control lever and provides a third connection point having suitable linkages for manipulating the third function, the second control lever follows the first control lever as it moves through the first plane but is independent of the first lever as it moves through the second plane, the first control lever follows the second control lever as it moves through the first plane but is independent of the second control lever as it moves through the third plane.

11. A control mechanism as defined by claim 10 wherein the main is provided with first, second and third downwardly projecting tangs, wherein the linkage for the first function is coupled to the first tang, the linkage for the second function is coupled to the second tang, and the stub shaft passes through the third tang.

12. A control mechanism as defined by claim 11 wherein the main ball joint is positioned between the first, and second and tangs.

13. A control mechanism as defined by claim 12 wherein each of the tangs is provided with an aperture for coupling the respective function linkage and stub shaft to the yoke.

14. A control mechanism as defined by claim 13 wherein the stub shaft is axially aligned with the aperture in the first tang forming an axis passing through the main ball joint.

15. A control mechanism as defined by claim 14 wherein the third aperture is arranged perpendicular to the axis formed by the stub shaft and the first aperture.

16. A control mechanism as defined by claim 13 wherein the link of the second lever is positioned between the guide slot of the lever mounting bracket and the third tang of the yoke.

17. A control mechanism as defined by claim 16 wherein the first and second connection points move vertically and the third connection point moves horizontally.

* * * * *